US007913639B2

(12) United States Patent
Canavoi et al.

(10) Patent No.: US 7,913,639 B2
(45) Date of Patent: Mar. 29, 2011

(54) DISPLAY FOR INDICATING THE DEPLETION OF CLEANING AGENTS OR AUXILIARY CLEANING AGENTS

(75) Inventors: Jan Canavoi, Düsseldorf (DE); Arno Düffels, Düsseldorf (DE); Arnd Kessler, Monheim-Baumberg (DE)

(73) Assignee: Henkel KGaA, Dusseldorf (DE)

( * ) Notice: Subject to any disclaimer, the term of this patent is extended or adjusted under 35 U.S.C. 154(b) by 615 days.

(21) Appl. No.: 11/578,095

(22) PCT Filed: Apr. 1, 2005

(86) PCT No.: PCT/EP2005/003417

§ 371 (c)(1),
(2), (4) Date: Jul. 11, 2007

(87) PCT Pub. No.: WO2005/099552

PCT Pub. Date: Oct. 27, 2005

(65) Prior Publication Data

US 2007/0283876 A1 Dec. 13, 2007

(30) Foreign Application Priority Data

Apr. 15, 2004 (DE) ..... 10 2004 018 911

(51) Int. Cl.

| | |
|---|---|
| ***G01D 11/00*** | (2006.01) |
| ***G01D 13/00*** | (2006.01) |
| ***F21S 10/00*** | (2006.01) |
| ***B08B 3/00*** | (2006.01) |
| ***G01C 15/02*** | (2006.01) |

(52) U.S. Cl. ..... 116/201; 116/200; 116/202; 134/56 D; 134/57 D

(58) Field of Classification Search ..... None
See application file for complete search history.

(56) References Cited

U.S. PATENT DOCUMENTS

| | | | | |
|---|---|---|---|---|
| 5,647,391 | A | 7/1997 | Chan et al. | |
| 5,839,454 | A | 11/1998 | Matz | |
| 6,138,693 | A * | 10/2000 | Matz | 134/57 D |
| 6,414,663 | B1 * | 7/2002 | Manross, Jr. | 345/87 |
| 2002/0088502 | A1 | 7/2002 | Van Rompuy et al. | |
| 2004/0050158 | A1 * | 3/2004 | Webb | 73/313 |

FOREIGN PATENT DOCUMENTS

| | | |
|---|---|---|
| CA | 2 214 139 | 7/1996 |
| DE | 35 13 640 | 10/1986 |
| DE | 88 14 550 | 1/1989 |
| DE | 197 57 679 | 7/1998 |
| DE | 697 06 159 | 12/2001 |
| DE | 695 31 905 | 9/2004 |
| EP | 1 493 375 | 1/2005 |
| JP | 2000338115 A * | 12/2000 |

OTHER PUBLICATIONS

Shinohara, Hiroo, Aug. 2000, JP 2000-338115, English machine translation.*

* cited by examiner

*Primary Examiner* — Michael Barr
*Assistant Examiner* — Jason Y Ko
(74) *Attorney, Agent, or Firm* — Connolly Bove Lodge & Hutz LLP

(57) ABSTRACT

The invention relates to a device for indicating the depletion of a cleaning agent or auxiliary cleaning agent introduced into a dishwasher machine for a plurality of washing programs. According to the invention, a display appliance is arranged on or in the dishwasher machine, indicating to the user the depletion of the cleaning agent or auxiliary cleaning agent.

11 Claims, No Drawings

DISPLAY FOR INDICATING THE DEPLETION OF CLEANING AGENTS OR AUXILIARY CLEANING AGENTS

RELATED APPLICATIONS

This application is a national stage application (under 35 U.S.C. 371) of PCT/EP2005/003417 filed Apr. 1, 2005, which claims benefit of German application 10 2004 018 911.0 filed Apr. 15, 2004.

The present invention relates to a device for displaying the depletion of a cleaning agent or an auxiliary cleaning agent (cleaning auxiliary) which has been introduced into a dishwasher for a plurality of wash cycles, and to a method for using such devices.

When washing dishes by machine in the household, cleaning agents are nowadays usually introduced into a metering chamber in the form of powder or tablets for a wash cycle, i.e. cleaning agent must be metered in again for each new cleaning operation. In addition, there are cleaning agents and, in particular, cleaning auxiliaries which last for a plurality of wash cycles. A consumption display which signals to the user that appropriate product needs to be refilled exists in most commercially available dishwashers for cleaning auxiliaries which are metered in by the dishwasher. In this manner, the consumption of rinse aid or regeneration salt is detected, for example, and a particular state is signaled to the user using acoustic or optical displays.

In contrast, dishwashers do not contain any consumption displays for cleaning agents and the consumption of these cleaning agents. In addition, a multiplicity of cleaning auxiliaries which are likewise not metered in by the machine but are consumed over a plurality of wash cycles, for example deodorants for the interior of the machine, glass protection products or additional products for the protection of silver, increased cleaning performance etc., have come into existence in the meantime.

In this case, there is the problem of displaying the depletion of cleaning agents or cleaning auxiliaries when the user should buy a corresponding new product and introduce it into the dishwasher. In order to solve this problem, chemical depletion displays which are intended to display, for the user, the depletion of the cleaning agent or cleaning auxiliary, for example by means of a color change of an indicator, have been developed. However, these color displays are unreliable and, in addition, the coloration of the indicator also depends not only on the number of wash cycles but also on the boundary conditions of the respective washing operation (temperature, duration, presence of particular constituents of cleaning agents etc.).

Another solution approach is to add cleaning auxiliaries to corresponding cleaning agents which can be individually metered in, so that the user obtains a new cleaning auxiliary when he buys a new packet of the cleaning agent. This has the disadvantage that the user is tied to particular packet sizes for the cleaning agent; in addition, it is not possible to separately sell the cleaning auxiliary in this manner.

Therefore, the invention is based on the object of providing a display device of the type mentioned initially which is free of said disadvantages and, in addition, is simple and cost-effective to produce, is technically improved, is more user-friendly and is also inexpensive.

In a first embodiment, the present invention relates to a device for displaying the depletion of a cleaning agent or a cleaning auxiliary which has been introduced into a dishwasher for a plurality of wash cycles, in which a display unit which displays, for the user, the depletion of the cleaning agent or cleaning auxiliary is arranged on or in the dishwasher.

The device according to the invention comprises a display unit which preferably does not have any active substances for the cleaning operation. The present invention does not relate to devices in which the process of displaying the depletion of a cleaning agent or a cleaning auxiliary, which has been introduced into a dishwasher for a plurality of wash cycles, merely involves displaying the fact that this cleaning agent or cleaning auxiliary is consumed.

Use is preferably made of a display unit whose method of operation is not based on chemicals or is not solely based on chemicals. In addition, decolorization of dyes or the like is preferably not included, or is not solely included, as the display unit. Preferred devices according to the invention are therefore characterized in that the display unit is a mechanical and/or magnetic and/or electrical and/or electronic display unit.

Since the user opens the dishwasher only to remove dishes which have been cleaned and to reload, preference is given to devices whose display units can be read not only when the dishwasher is open but also when it is closed. Preferred devices according to the invention are therefore characterized in that the display unit is arranged outside the operating area of the dishwasher.

Irrespective of the configuration of the display unit, i.e. whether it is electrical, electronic, magnetic or mechanical, the display unit can be used to display, for the user, the depletion of the cleaning agent or cleaning auxiliary not only as a function of time but also as a function of the number of wash cycles, the type of wash cycles etc. The parameter which is selected to control the display can be selected in this case as a function of the desired precision (selectivity) of the display or the cleaning agent or cleaning auxiliary to be determined.

For example, preference is thus given to devices according to the invention in which a display unit which displays, for the user, the depletion of the cleaning agent or cleaning auxiliary as a function of time is arranged on or in the dishwasher.

In these devices, the user activates the device as soon as he introduces a new cleaning agent or cleaning auxiliary into the dishwasher. After an amount of time in which the cleaning agent or cleaning auxiliary is usually consumed has elapsed, the display unit indicates that it is necessary to renew the cleaning agent or cleaning auxiliary. For example, preference is given to outputting a signal on the display unit when a period of time of from two to twenty weeks, preferably from three to 16 weeks and, in particular, from four to 12 weeks, has elapsed.

It is obvious that the selectivity of such a device is not particularly high since the number of wash cycles which are usually carried out per unit time can vary as a function of little use as a result of holiday periods, heavy use as a result of parties or the like.

Irrespective of the configuration of the display unit, i.e. whether it is electronic or mechanical, the display unit can be used, when developing the invention, to display, for the user, the depletion of the cleaning agent or cleaning auxiliary not only as a function of time but also as a function of other parameters which have a higher selectivity for the consumption of the agent. A combination of the measurement of time and other parameters in order to draw conclusions therefrom regarding the extent of depletion of the cleaning agent or cleaning auxiliary has hitherto been unknown in the prior art because it does not seem possible to the user to take into account both parameters.

In particular, it is possible, according to the invention, for the display unit to be connected to a structure which is fitted to a movable part and triggers a switching operation upon this movement. Moving one part of the dishwasher relative to another part makes it possible for particular movements which are correlated with the number of cleaning operations to be detected and to be used as triggers for a display signal. For example, moving the door, a slide, a switch, a refilling device or the like thus makes it possible, when using the structure according to the invention, to trigger a switching operation which, in turn, gives rise to a display in the device according to the invention. Unlike mechanical interventions which presuppose complicated production with a large degree of precision and are subject to abrasion, a switching operation without the movement of mechanical parts is possible, in particular when use is made of a magnetic or electrical structure which simultaneously also gives rise to a display. It is apparent that such a display device is simpler, is more robust and is preferred by the end user.

Another alternative embodiment of the device according to the invention in which the switching operation is triggered by moving two parts of the apparatus relative to one another if their movement is required for a cleaning operation is also possible.

In another preferred device according to the invention, a display unit which displays, for the user, the depletion of the cleaning agent or cleaning auxiliary as a function of the number of times the door of the dishwasher is opened is arranged on or in the dishwasher.

In these devices, the user activates the device as soon as he introduces a new cleaning agent or cleaning auxiliary into the dishwasher. After a defined number of operations of opening the dishwasher, the display unit indicates that it is necessary to renew the cleaning agent or cleaning auxiliary. In this case, it is possible and preferred to output a signal after 40 to 1200, preferably after 80 to 1000 and, in particular, after 120 to 800, opening operations, for example.

The selectivity of this device is higher since the number of operations of opening a dishwasher is relatively constant for a particular number of cleaning operations. However, a fluctuation may also occur here, for instance when the dishwasher is opened only once per wash cycle in the case of heavy use as a result of parties or family celebrations or is opened frequently in the case of little use (repeatedly putting in individual dishes over a relatively long period of time).

Another movement operation which can be used as a trigger for a signal is the operation of removing the dish racks from the machine. In this case, preferred devices according to the invention are characterized in that a display unit which displays, for the user, the depletion of the cleaning agent or cleaning auxiliary as a function of the number of movements of at least one dish rack is arranged on or in the dishwasher.

After a defined number of movements of at least one dish rack, the display unit indicates that it is necessary to renew the cleaning agent or cleaning auxiliary. In this case, it is possible and preferred to output a signal after 10 to 800, preferably after 20 to 600 and, in particular, after 40 to 400, movements, for example.

It goes without saying that the number of cleaning operations which have been carried out can also be used as a controlled variable, for example by using the on/off switch of the dishwasher as a movable part. Preference is given to devices according to the invention in which a display unit which displays, for the user, the depletion of the cleaning agent or cleaning auxiliary as a function of the number of cleaning programs which have been carried out is arranged on or in the dishwasher.

It goes without saying that the abovementioned controlled variables can also be combined with one another. For example, it is thus possible for the signal to be displayed as a function of time and the number of times the door of the dishwasher is opened, as a function of time and the number of movements of the dish racks of the dishwasher, as a function of time and the number of cleaning operations of the dishwasher, as a function of the number of times the door of the dishwasher is opened and the number of movements of the dish racks of the dishwasher and as a function of the number of times the door of the dishwasher is opened and the number of cleaning operations of the dishwasher.

Devices which are particularly preferred according to the invention are characterized in that the display unit is connected to a structure which is fitted to a movable part of the dishwasher and whose movement triggers a switching operation. As a result of the switching operation, the electrical pulse is available in the electronic display unit in order to carry out a counting operation and to also display the latter.

The structure which is preferably fitted to a movable part of the dishwasher (door, dish rack, switch, closure flap of the metering chamber etc.) is integrated in the display unit in devices which are preferred according to the invention.

In order to measure the time and output signals as a function of time, there are time-dependent controllers which provide partial displays after particular periods of time have elapsed and then provide complete displays which the user can use to identify that the cleaning agent or cleaning auxiliary has been depleted. In addition to this or in combination with this, the electronic display unit can be used to measure not only the amount of time which has elapsed but also, instead of this or in combination with this, additionally the quantity of cleaning agent or cleaning auxiliary which has been consumed and can be used to display the result of this. Although this measurement is effected indirectly using the movement of mechanical parts relative to one another, it is nevertheless reliably and very precisely approximated to the actual quantity consumed. The door of the dishwasher was mentioned above, by way of example, as a movable part. If a particular quantity of cleaning agent or cleaning auxiliary which is consumed after the door has been opened once is assumed, the operation of opening the door once and subsequently closing it can be calibrated as the consumption of a particular quantity of cleaning agent or cleaning auxiliary. Because this opening operation triggers switching in the electronic display unit, this circuit signifies the consumption of a particular quantity which can then be displayed.

All parts in a dishwasher which can be moved relative to one another are conceivable as signal transmitters. "AND" and/or "OR" circuits make it possible to electronically combine time measurement and quantity measurement in a manner known per se. This measure also makes use of the present invention, with the result that the display unit according to the invention makes it possible to realistically detect and even display the depletion of the cleaning agent or cleaning auxiliary as a function of both time and the number of cleaning operations.

According to the invention, one preferred embodiment provides for the structure to have a reed switch and for a magnet to be fastened to a movable part of the dishwasher.

The part which is connected to the dishwasher may be any appropriate part to which a magnet can be fastened in a convenient and technically simple manner, said magnet being able to trigger the abovementioned switching operation when it approaches or moves away from the reed switch. It is known practice to use reed switches having very small dimensions if low levels of power are sufficient for the desired functions. If an electrical pulse or else the display of the field of a display unit or a light source, for example an LCD, is involved, very low levels of electrical power and very small reed switches are sufficient.

In preferred devices according to the invention, the magnet is fitted to the door and/or to a dish rack and/or to the program selector switch and/or to the on/off switch.

According to the invention, it is preferred to use a display unit which has a viewing pane having a plurality of display panels, which are arranged next to one another, and preferably has a reset button. Accordingly, devices which are preferred according to the invention are characterized in that the display unit is a viewing pane having a plurality of display panels which are arranged next to one another. Before the display device of the invention is started up, energy can be saved as long as the unit is unsold in a warehouse, for example. After purchase, the user can activate the display unit by operating the reset button and can follow the desired functions by viewing the display panels. As a result of a transparent pane, a plate, a panel or the like as a viewing pane, one or more display panels are the information carriers if they are visible, are flashing or are invisible.

Digital light-emitting diodes may also be used instead of display panels. The units of time and/or units for opening operations etc. may be set to days, weeks, months or years or to a number depending on the wishes of the user.

In devices which are preferred according to the invention, the display unit comprises a liquid-crystal display (LCD).

The present invention also relates to a method for displaying the depletion of a cleaning agent or a cleaning auxiliary which has been introduced into a dishwasher for a plurality of wash cycles, in which a device according to the invention is fitted on or in the dishwasher.

The present invention also relates to the use of display units, which are connected to a structure which is fitted to a movable part of the dishwasher and whose movement triggers a switching operation, for displaying the depletion of a cleaning agent or a cleaning auxiliary which has been introduced into a dishwasher for a plurality of wash cycles and to the use of mechanical and/or magnetic and/or electrical and/or electronic display units for displaying the depletion of a cleaning agent or a cleaning auxiliary which has been introduced into a dishwasher for a plurality of wash cycles.

The invention claimed is:

1. A method for displaying on a dishwasher having a reservoir for holding an amount of a dish cleaning agent or dish cleaning auxiliary for multiple dishwasher cleaning cycles, an electronic display unit fitted in a dishwasher interior or on a dishwasher exterior to display a reservoir refill indicator, a time-dependent controller, and a structure fitted to a movable part of a dishwasher, comprising:

receiving a setting for a duration of time with a time-dependent controller;

after the passing of the duration of time, causing the electronic display unit to display the reservoir refill indicator, which displays the depletion of the cleaning agent or cleaning auxiliary in the reservoir as a function of time, with the controller;

triggering a switching operation for the controller when the movable part having a structure fitted is moved and correlating the switching operation to a count of number of dishwashing cleaning cycles that have been carried out;

detecting the switching operation for the controller;

after a threshold number of switching operations are detected, notwithstanding if the duration of time has passed, causing the display of the reservoir refill indicator, which displays the depletion of the cleaning agent or cleaning auxiliary in the reservoir as a function of a time, with the controller.

2. The method of claim 1, wherein the display unit is arranged outside the dishwasher.

3. The method of claim 1, wherein counting the number of dishwashing cleaning cycles is correlated as a function of the number of times a door of the dishwasher is opened.

4. The method of claim 1, wherein counting the number of dishwashing cleaning cycles is correlated as a function of the number of movements of at least one dish rack.

5. The method of claim 1, wherein counting the number of dishwashing cleaning cycles is correlated as a function of the number of times an on/off switch of the dishwasher is switched.

6. A dishwasher detergent or dishwasher auxiliary depletion display device, comprising:

a reservoir being of a size for holding a dish cleaning agent or dish cleaning auxiliary in an amount for multiple dishwasher cleaning cycles;

an electronic display unit fitted in a dishwasher interior or on a dishwasher exterior to display a reservoir refill indicator;

a time-dependent controller configured to receive a setting for a duration of time after the passing of which the controller is configured to cause the electronic display unit to display the reservoir refill indicator, which displays the depletion of the cleaning agent or cleaning auxiliary in the reservoir as a function of time; and a structure fitted to a movable part of a dishwasher, wherein movement of the movable part triggers a switching operation for the controller that is correlated to a count of the number of dishwashing cleaning cycles that have been carried out, and wherein the controller is configured to cause the electronic display unit to display the reservoir refill indicator, which displays the depletion of the cleaning agent or cleaning auxiliary in the reservoir as a function of time after a threshold number of switching operations is detected, notwithstanding if the duration of time has passed and without visually inspecting the reservoir contents.

7. The display device of claim 6, wherein the structure includes a reed switch, and further comprising a magnet fastened to the movable part of the dishwasher.

8. The display device of claim 6, wherein the movable part is a dish rack.

9. The display device of claim 6, wherein the movable part is an on/off switch of the dishwasher.

10. The display device of claim 6, wherein the movable part is a dishwasher door.

11. The display device of claim 6 wherein the electronic display unit is a liquid-crystal display (LCD).

* * * * *